US006118734A

United States Patent [19]

Ray et al.

[11] Patent Number: 6,118,734

[45] Date of Patent: Sep. 12, 2000

[54] TRAIN OF CLOCKWORK WITH PERPETUAL JULIAN DATE

[75] Inventors: Claude Ray, Montezillon, Switzerland; Christian Taillard, Les Fins, France

[73] Assignee: Girard-Perregaux, S.A., La Chaux-de-Fonds, Switzerland

[21] Appl. No.: 09/355,052

[22] PCT Filed: Jan. 26, 1998

[86] PCT No.: PCT/CH98/00027

§ 371 Date: Jul. 23, 1999

§ 102(e) Date: Jul. 23, 1999

[87] PCT Pub. No.: WO98/34162

PCT Pub. Date: Aug. 6, 1998

[30] Foreign Application Priority Data

Jan. 30, 1997 [CH] Switzerland ..... 191/97

[51] Int. Cl.[7] ..... G04B 19/20; G04B 19/24

[52] U.S. Cl. ..... 368/37; 368/38

[58] Field of Search ..... 368/28, 34–38

[56] References Cited

U.S. PATENT DOCUMENTS

| | | | |
|---|---|---|---|
| 3,716,983 | 2/1973 | Tanaka et al. | 368/37 |
| 3,827,234 | 8/1974 | Imanishi | 368/38 |
| 4,026,100 | 5/1977 | Kume et al. | 368/37 |

FOREIGN PATENT DOCUMENTS

| | | |
|---|---|---|
| 542645 | 8/1922 | France . |
| 854926 | 3/1940 | France . |
| 1358534 | 7/1964 | France . |
| 2005052 | 4/1979 | Japan . |

*Primary Examiner*—Vit Miska
*Attorney, Agent, or Firm*—R. William Beard, Jr.; Frohwitter

[57] ABSTRACT

A train of clockwork with perpetual Julian date, characterized in that it comprises an adjusting device for causing a date indicator (2) to carry out adjusting steps, for automatically taking into account months with 28, 29, or 30 days, said adjusting device comprising a rotating cam (26) driven at least one step every twenty-four hours, said cam (26) having an outline (28) for controlling a sensor (30) bringing about: the oscillating motion of a mobile element (32) provided with a click spring system (34), for moving forward the date indicator (2) by the required supplementary step(s), and the forward movement of said cam (26) for causing it to make the number of steps equal to the number of adjusting steps of said indicator (2) for carrying out one complete round every year.

25 Claims, 15 Drawing Sheets

TRAIN OF CLOCKWORK WITH PERPETUAL JULIAN DATE

The present invention concerns a timepiece movement provided with a perpetual-date calendar mechanism, comprising a device for driving a date indicator, which device comprises a driver capable of making the indicator advance one jump every 24 hours.

BACKGROUND OF THE INVENTION

Field of the Invention

This movement further comprises an adjusting device for causing this indicator to carry out supplemental adjusting steps, in order to automatically allow for months with 28, 29 or 30 days.

More particularly, and in advantageous fashion, this movement is designed to be able to easily adapt on a movement comprising a driving device of a conventional date display.

Moreover, the movement according to the invention makes it possible to display supplemental day, month and/or year information, without making major modifications to the movement.

There is already known from the Swiss patent CH 574 125 a control mechanism of a semiperpetual calendar, comprising a date ring whose single lever accomplishes the intermediate daily advance and the correction, at the end of certain months, by means of a mechanism. This correction is done by means of a mechanism comprising a month cam in connection with a device for locking the date ring. Such a mechanism has the disadvantage of being complex and costly to implement.

Furthermore, this mechanism is semiperpetual, that is, it does not take into account leap years and it requires the use of a day display and monthly correction mechanism.

Furthermore, there is known from patent EP 0 052 070 a perpetual driving device for the date ring, comprising a month cam and a year cam to perform the required correction of the display at the end of months with fewer than 31 days. This design is complicated and cannot be adapted to a movement comprising a traditional date display device. Furthermore, this system does not allow the display of information supplemental to the date display, such as the day, months, and the leap year.

The Swiss patent CH 169 64 describes a mechanism which does not take account of leap years and which comprises a system of small-dimension, variable-notch cams, arranged between the center of the movement and its periphery. The small dimensions of this cam system do not allow one to obtain satisfactory precision.

SUMMARY OF THE INVENTION

Thus, the object of the present invention is to remedy the drawbacks of the aforesaid prior art by providing a timepiece movement with a perpetual calendar, which can be easily adapted to a movement already comprising a conventional date display device, which offers great precision of functioning and which, moreover, allows the display of supplemental information along with the date, such as the month and/or leap years and non-leap years, as well as a 24 h display which can be initialized after the clock has stopped.

Thus, the invention concerns a timepiece movement provided with a perpetual-date calendar mechanism, comprising a device for driving a date indicator, this device comprising driving means which can make said indicator advance by one jump every 24 hours. This movement is characterized in that it further comprises an adjusting device, arranged to make this indicator carry out supplemental adjusting steps, in order to automatically allow for months of 28, 29 or 30 days, this device comprising a rotary cam driven at least one step every 24 hours, this cam having a profile for controlling a sensor, bringing about:

on the one hand, the oscillating movement of a mobile assembly provided with a ratchet system, to make the date indicator advance by the required supplemental adjusting step or steps, and on the other hand, the advancement of said cam to make it carry out a number of steps equal to the number of adjusting steps of said indicator so that it performs one complete turn every year.

BRIEF DESCRIPTION OF THE DRAWINGS

Other characteristics and advantages of the invention will appear from reading the following detailed description, making reference to the enclosed drawings, which are given solely by way of example, and on which.

DETAILED DESCRIPTION OF THE INVENTION

Figure 8:
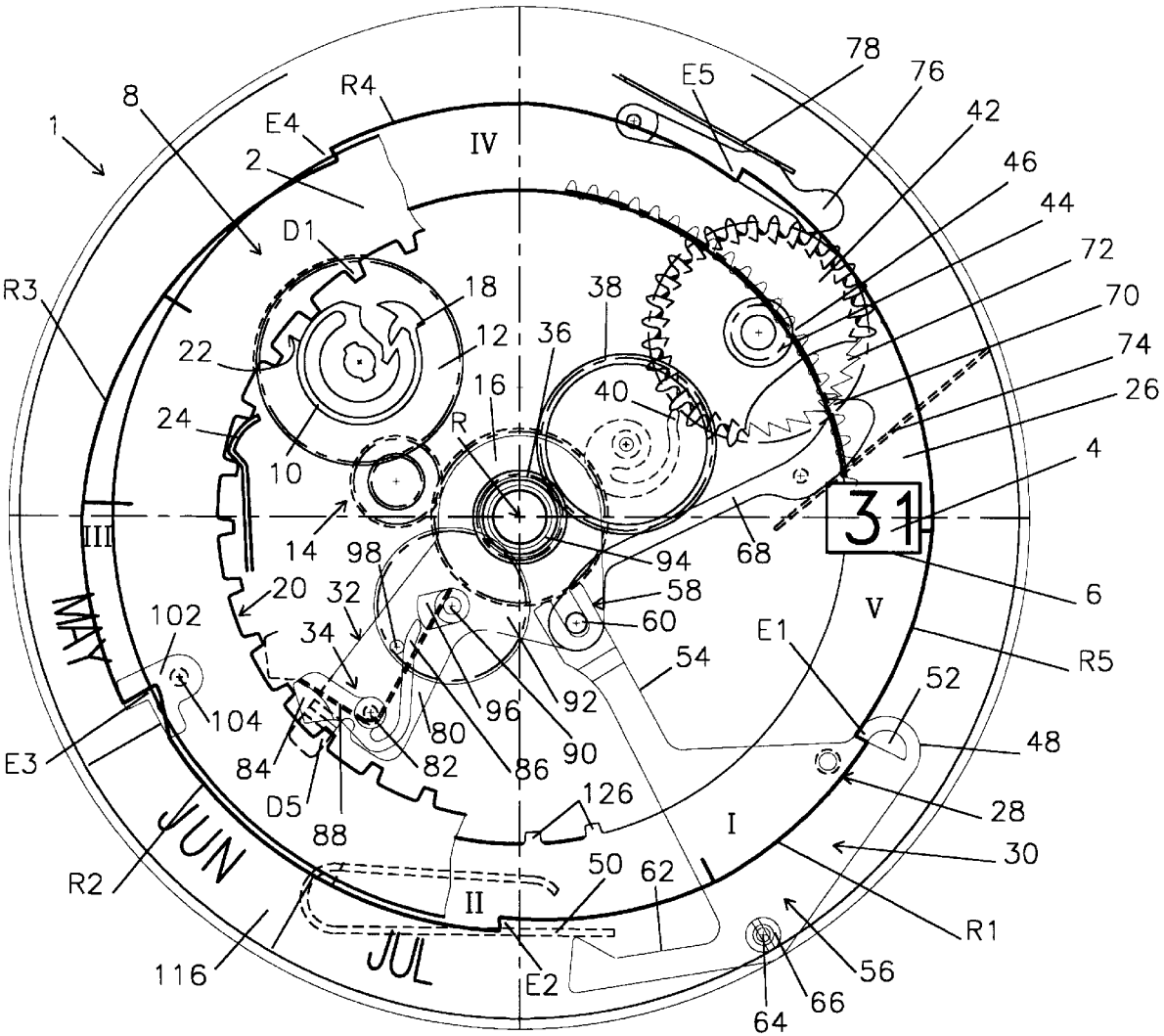

Referring now to FIG. 8, the movement according to the invention shall be described hereafter, designated by the general reference 1.

The movement 1 comprises a calendar mechanism of perpetual date, comprising a date ring 2 that carries date information 4. This information appears in a window 6 of a dial, which is not shown.

The ring 2 is associated with a driving device 8, comprising driving means consisting of an elastic arm 10 integrated with a 24-hour wheel, designated 12. The wheel 12 engages with a mobile element 14, meshing with an hour cannon wheel 16, which makes one turn every twelve hours.

The elastic arm 10 comprises at its free end a hook 18 intended to engage with an interior toothing 22 of the ring 2, in order to cause the date ring 2 to advance once every 24 hours, when the hook 18 engages with a tooth of this toothing 22.

A jumper spring 24 maintains the ring 2 in fixed position until the hook 18, caused to rotate by the wheel 12, engages with the tooth, for example, D1, and winds the elastic arm 10 until it overcomes the force of the jumper spring 24 and moves, in almost instantaneous fashion, the date ring 2 by one jump, to change from one date to the following date.

It will be noted that the device 8 is designed such that, after changing to the following date, as explained above, the hook 18 disengages from the toothing 22 in order to allow, if necessary, a supplemental advancement of the ring 2 so that it can carry out one or more adjusting steps and to take into account months having fewer than 31 days, by means of an adjusting device which will be described hereafter.

The driving device 8 is a conventional device which will not be described in more detailed manner.

According to the invention, the movement 1 comprises an adjusting device provided with a rotary cam 26, driven at least one step every 24 hours and making one complete round every year.

The cam 26 is guided in rotation, for example, at the surface of the movement, by means not shown, and it has a profile 28 intended to guide a sensor 30.

The sensor 30 controls, first, the oscillating movement of a mobile assembly 32, which is provided with a pawl system 34, intended to make the ring 2 advance by the required adjusting step or steps.

The sensor 30 controls, secondly, the advancement of the cam 26, in order to make it perform a number of steps equal to the number of adjusting steps of the ring 2.

The cam 26 is driven by a gear train connected to the hour wheel 16. More specifically, the hour cannon wheel 16 (hereafter termed the hour wheel) carries a pinion 36 engaging with the wheel 38 of a first mobile element. This first mobile element comprises a finger 40 integrated with the wheel 38. The gearing down ratio between the pinion 36 and the wheel 38 is such that the wheel 38 makes one rotation every 24 hours. The finger 40 interacts with the toothing of a 31-tooth wheel 42, belonging to a second mobile element whose pinion 44 drives the cam 26.

It will be noted that the finger 40 is positioned during the assembly such that it makes contact with the toothing of the wheel 42 after the driving device 8 has permitted the ring 2 to jump.

The cam 26 has an annular shape surrounding the mobile assembly 32 and the driving device 8. The cam 26 and the hour wheel 16 have the same axis of rotation R.

The cam 26 has an internal toothing 46 which interacts with the pinion 44 to drive this cam in rotation.

The sensor 30, which has the general shape of an anchor, comprises a first arm 48 which lies, under the action of a return spring 50, against the profile 28 of the cam 26 by a pallet pin 52.

The pallet pin 52, which is in permanent contact with the profile of the cam 26, has a semispherical shape and is arranged in the vicinity of the free end of the arm 48. This pallet pin 52 is preferably made of synthetic ruby.

The sensor 30 has a second arm 54 which is connected to the first arm 48 by a junction piece 56. This second arm 54 is coupled to the mobile assembly 32 by its free end, which has the shape of a fork 58 whose teeth are engaged, in the example shown, with a pin 60 that is integrated with the mobile assembly 32.

The sensor 30 has a third arm 62, extending from the junction piece 56 essentially in the prolongation of the first arm 48 and whose end interacts with the spring 50 in order to push the pallet pin 52 in the direction of the profile of the cam 26.

To accomplish this, the sensor 30 can pivot by its junction piece 56, via a pivot pin 64, on the movement, for example, on a plate (not shown).

The pivot pin 64 of the sensor 30 is associated with an eccentric 66, which enables the final adjustment of the pallet pin 52 with respect to the profile 28 of the cam 26.

In the example shown, the sensor 30 and the spring 50 extends basically underneath the cam 26.

The mobile assembly 32 is also associated with a mobile lever 68 which articulates by one of its free ends with the pin 60, this lever 68 being controlled by the sensor 30. The other free end of the lever 68 has a tip 70 engaging with a saw-tooth wheel 72. This wheel 72 is integrated with the wheel 44 belonging to the mobile element driving the cam 26. The lever 68 is kept engaged with the wheel 72 by means of a leaf spring 74, which rests laterally against the back of the tip 70, in a radial direction of the wheel 72.

Furthermore, it shall be specified that the wheels 72 and 42 which belong to the mobile element driving the cam 26 are held in position, between each step, by a jumper 76, actuated by a spring 78.

The element 32 comprises a base plate 80, mounted in rotation about the axis R, around the hour wheel 16. The base plate 80 extends from the center of the movement in radial direction to the ring 2. This plate 80 carries the pawl 34 which is mounted in rotation on this plate by means of a pivot 82.

The pawl 34 is comprised of a tip 84 for engaging with the toothing 22 of the ring 2 and an elastic arm 86 which extends above the plate 80. In this example, the arm 86 extends in the direction of the center of the movement.

The pawl 34 also comprises a spring 88, acting on the tip 84 to make it enter the toothing 22 of the ring 2. In the example illustrated, the spring 88 has the general shape of an L, which partially surrounds the pivot 82 and whose one branch rests against one side of the tip 84, while the other branch rests against an pin 90, integrated with the plate 80.

The pin 90 carries a 24-hour wheel, designated 92, which engages with a pinion 94, integrated with the hour cannon. The pin 90 also carries an inertial cam 96, which is driven by the wheel 92, this inertial cam 96 periodically interacting with the end of the arm 86 to lock this arm 86 against a pin 98, likewise borne by the base plate 80.

As will be understood from the detailed functional description of the movement according to the invention, this arrangement constitutes a system of locking, making it possible every two months to lock the displacement of the arm 86 of the pawl 34 to disassemble it at the moment of the adjusting jump or jumps. Thus, this system of locking, in a first position, maintains the tip 84 nearly stationary so that this tip 84 ensures the driving of the ring 2. In a second position, this system of locking releases the tip 84 so that it performs its ratchet function with respect to the ring 2, when this ring 2 is actuated, in particular, by the driving device 8.

The profile 28 of the cam 26 is formed of five contiguous sectors, designated I to V, joined together by recesses forming notches E1 to E5. The depth of the notches E1 to E5 determines the radial displacement of the sensor 30 and, in particular, the radial displacement of the pallet pin 52 to make the ring 2 carry out the required number of adjusting steps at the end of months having fewer than 31 days.

The five sectors I to V form continuous ramps R1 to R5 which extend in the counterclockwise direction. These ramps R1 to R5 extend from the bottom of one notch $E_n$ to the apex of a following notch $E_{n+1}$, from a first radius to a second radius greater than the first.

One of the notches designated E3, has a greater depth than that of the other four notches E1, E2, E4, E5, these latter having depths equal to each other.

The notches E1, E2, E4 and E5 have depths such as to make the sensor 30 move to control, by the mobile assembly 32, the displacement of the ring 2 by one adjusting step at the end of a month with 30 days (April, June, September, November), while the notch E3 has a depth such as to make the sensor 30 move to control, likewise by the mobile assembly 32, the displacement of the ring 2 by two or three adjusting steps, respectively, at the end of months with 29 and 28 days (leap and non-leap February).

Figure 13:
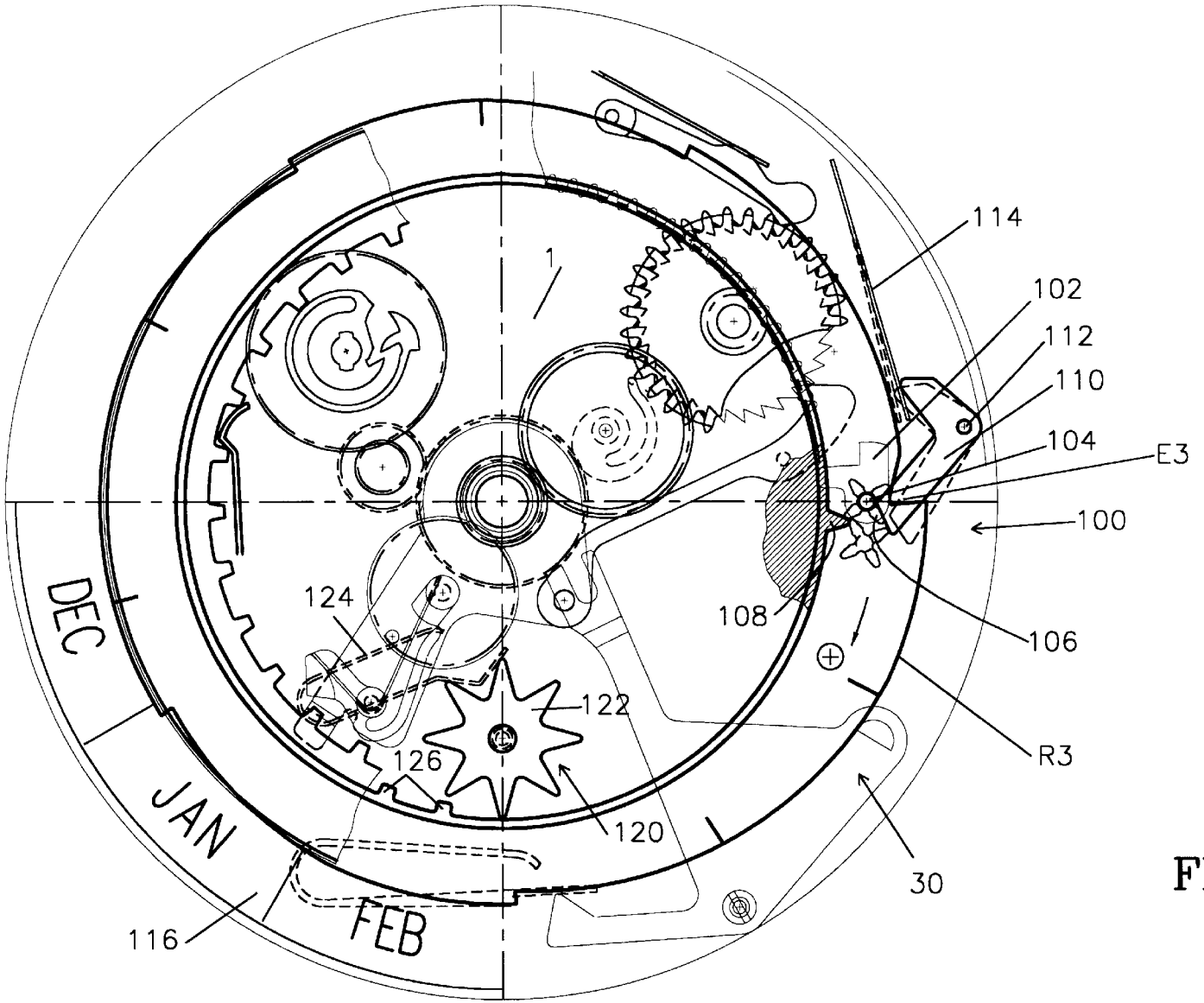
FIG. 13 is likewise a top view of the movement according to the invention, in which one sees the moving flap system making it possible to allow for months of February with 29 days (leap years)
Figure 14:
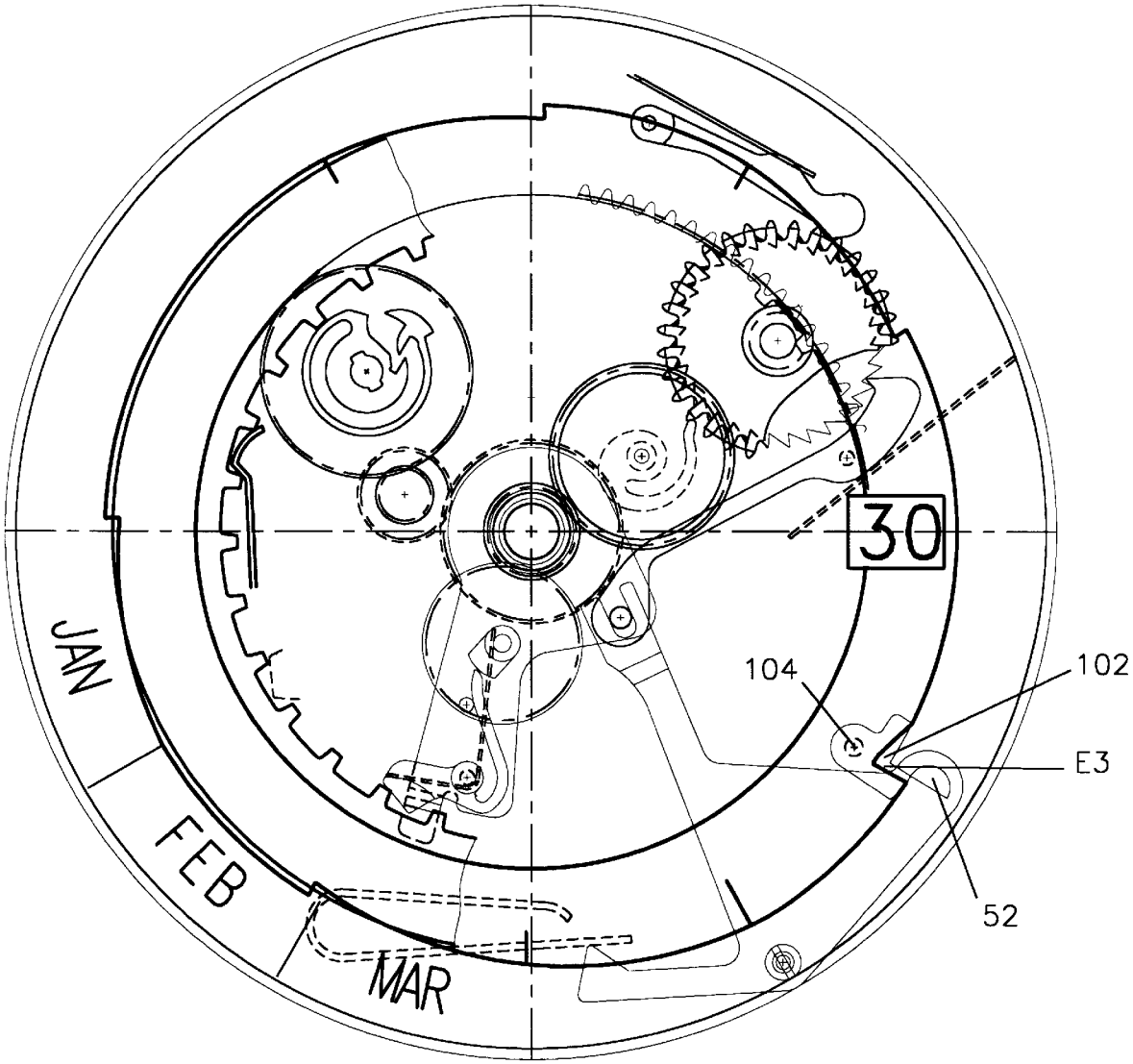
FIGS. 14 and 15 show the condition of the movement after the changing from 29 to 30 of the month of February in a leap year, before (FIG. 14) and after the changing to the $1^{st}$ of the following month (FIG. 15).
Figure 15:
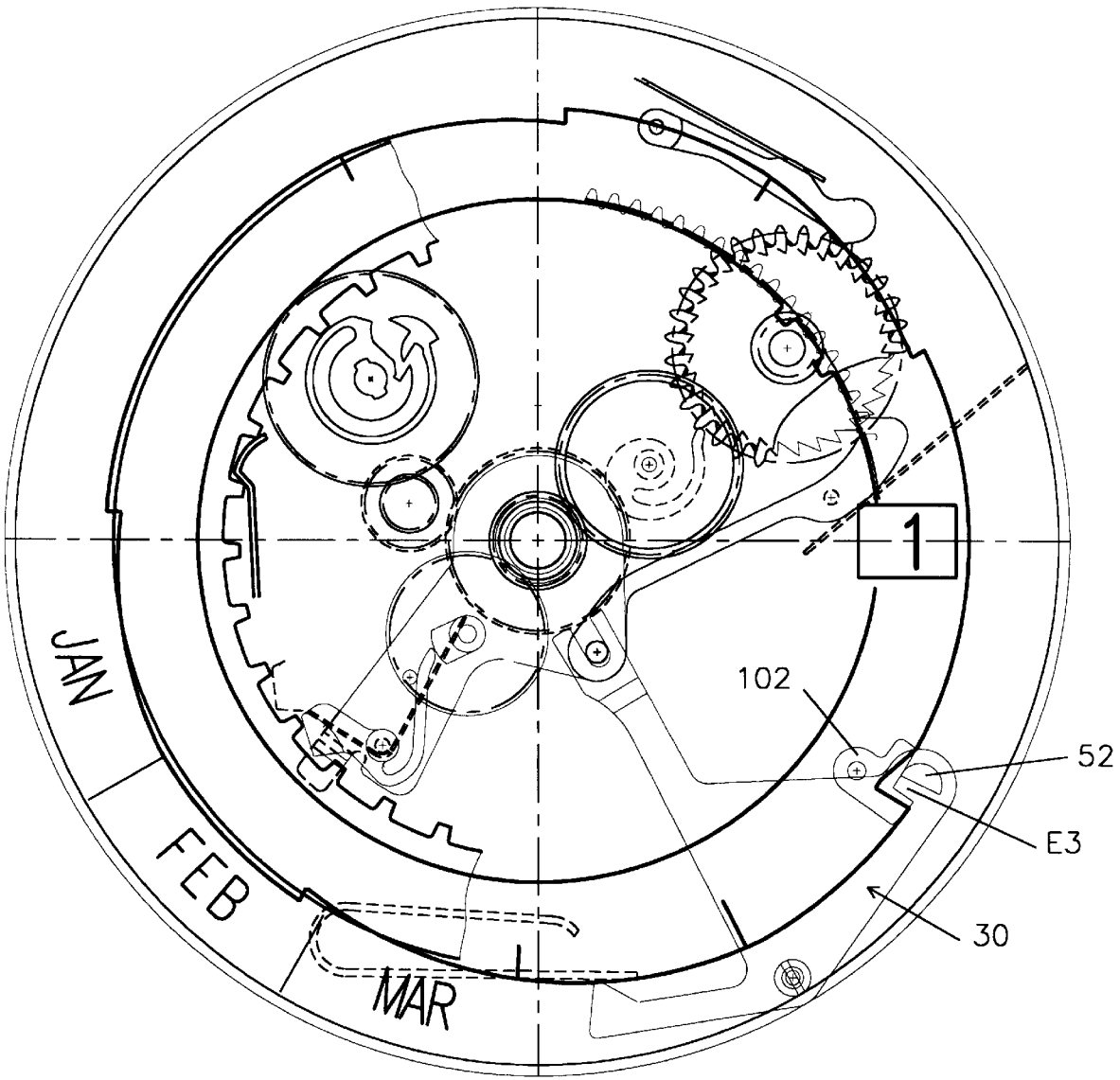

For this, the depth of the notch E3 is not constant. The notch E3 is associated with a system, designated 100, capable of causing its depth to vary once every four years. This system 100, visible in FIG. 13, is formed by a mobile flap 102, mounted in rotation on the cam 26 by means of a pin 104. The pin 104 carries a wheel 106, making one turn every four years. This wheel being thus actuated upon each complete rotation of the cam for a quarter turn. For this, the system 100 interacts once a year with a fixed finger of the movement, designated 108. Thanks to this arrangement, the mobile flap 102 can close the notch E3 once every four years in order to reduce its depth. This makes it possible to limit the displacement of the sensor 30 so that the latter only makes the ring 2 perform two adjusting steps at the end of the February months of leap years.

Furthermore, the flap 102 has a shoulder which, when the flap comes to close the notch E3, elongates the length of the ramp R3 by a distance corresponding to one day.

The wheel 106 is maintained in position by a L-shaped jumper 110, mounted in rotation by means of a pivot 112 which is supported by a crown 116, forming a month ring integrated with the cam.

This jumper 110 interacts with a return spring 114, which acts on one of the branches of the L so that the other branch comes to enter between two teeth of the wheel 106, this second branch having an end provided for this purpose. Thus, the catch 110 and its spring 114 turn along with the cam 26 at the rate of one complete round each year.

There is also shown in FIG. 13 a device for display of leap years 120, which can advantageously complement the movement 1.

The device 120 comprises a star 122, carrying a year display hand (not shown), this hand being pivoted on the movement 1. The star 122 is maintained by a jumper spring 124, ensuring the positioning of the hand. In the example shown, the star 122 has eight branches and is driven by two drive teeth 126 integrated with the cam 26. Thus, the star 122 is controlled, once a year, by the two teeth to carry out a quarter turn at every complete rotation of the cam. This display is valuable for showing the leap year.

Referring to FIGS. 1–15, the functioning of the movement according to the invention shall be described hereafter.

Figure 1:
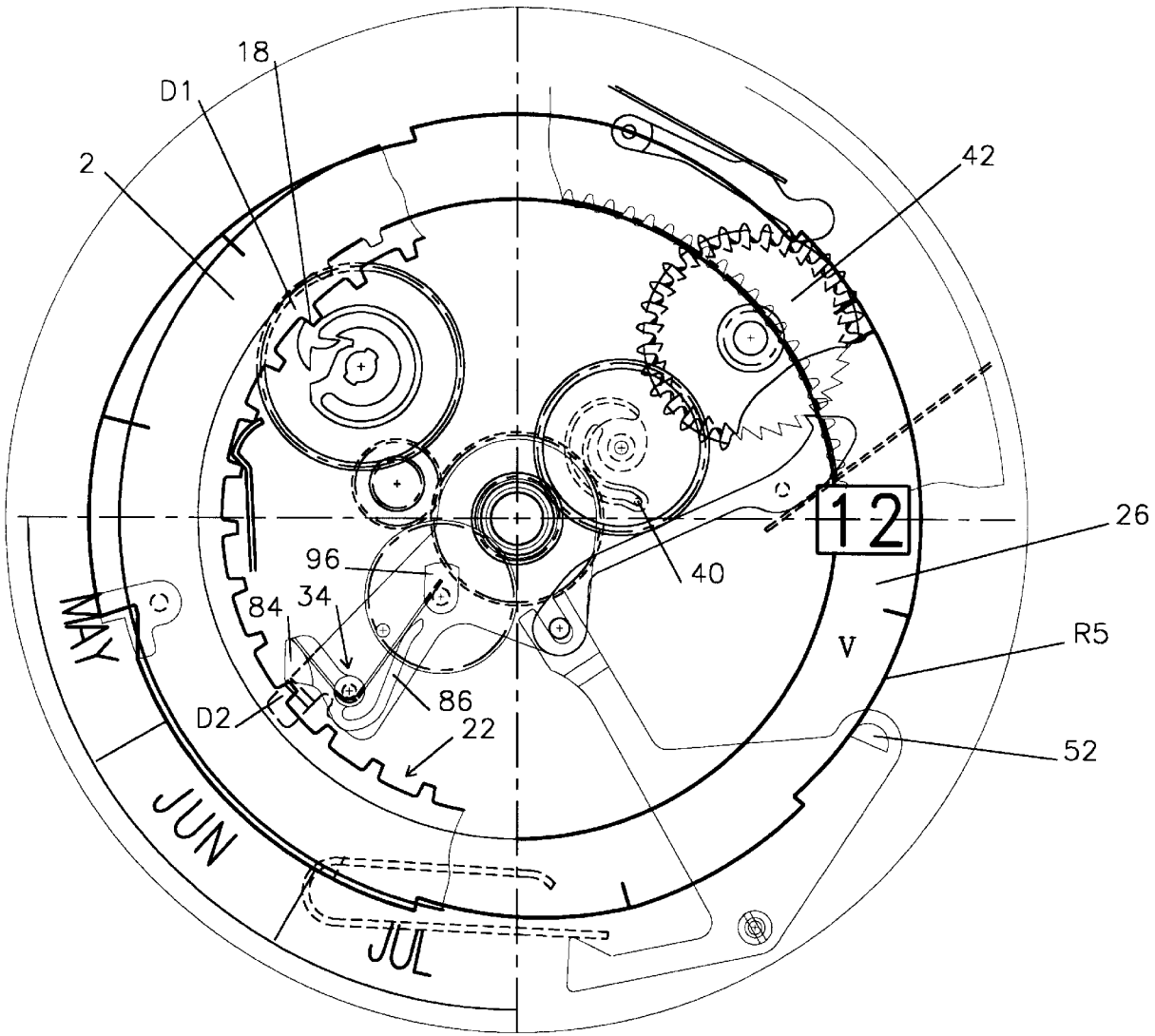
FIGS. 1 to 6 are top views of the movement according to the invention, showing the condition of the movement before (FIGS. 1 and 2), during (FIG. 3), and after (FIGS. 4, 5 and 6) the changing from one date, for example, in the middle of the month, such as the "12", to the next date.

In FIG. 1, we see the conventional date driving device, at 21:00 o'clock, that is, at the start of its winding to trigger a usual jump, upon changing from the $12^{th}$ to the $13^{th}$ of the month.

The hook 18 of the elastic arm 10 comes to abut against a tooth D1 of the toothing 22. The pallet pin 52 is in process of ascending the ramp R5. The inertial cam 96 has not reached the end of the arm 86 of the pawl 34. Thus, the tip 84 can slowly ascend the flank of a tooth D2. The pawl 34 is thus free and allows either the function of future changing of the date or a rapid resetting of the date by means of a device not described.

Moreover, the end of the finger 40 at this time has not yet reached one of the teeth of the 31-tooth wheel 42.

Figure 2:
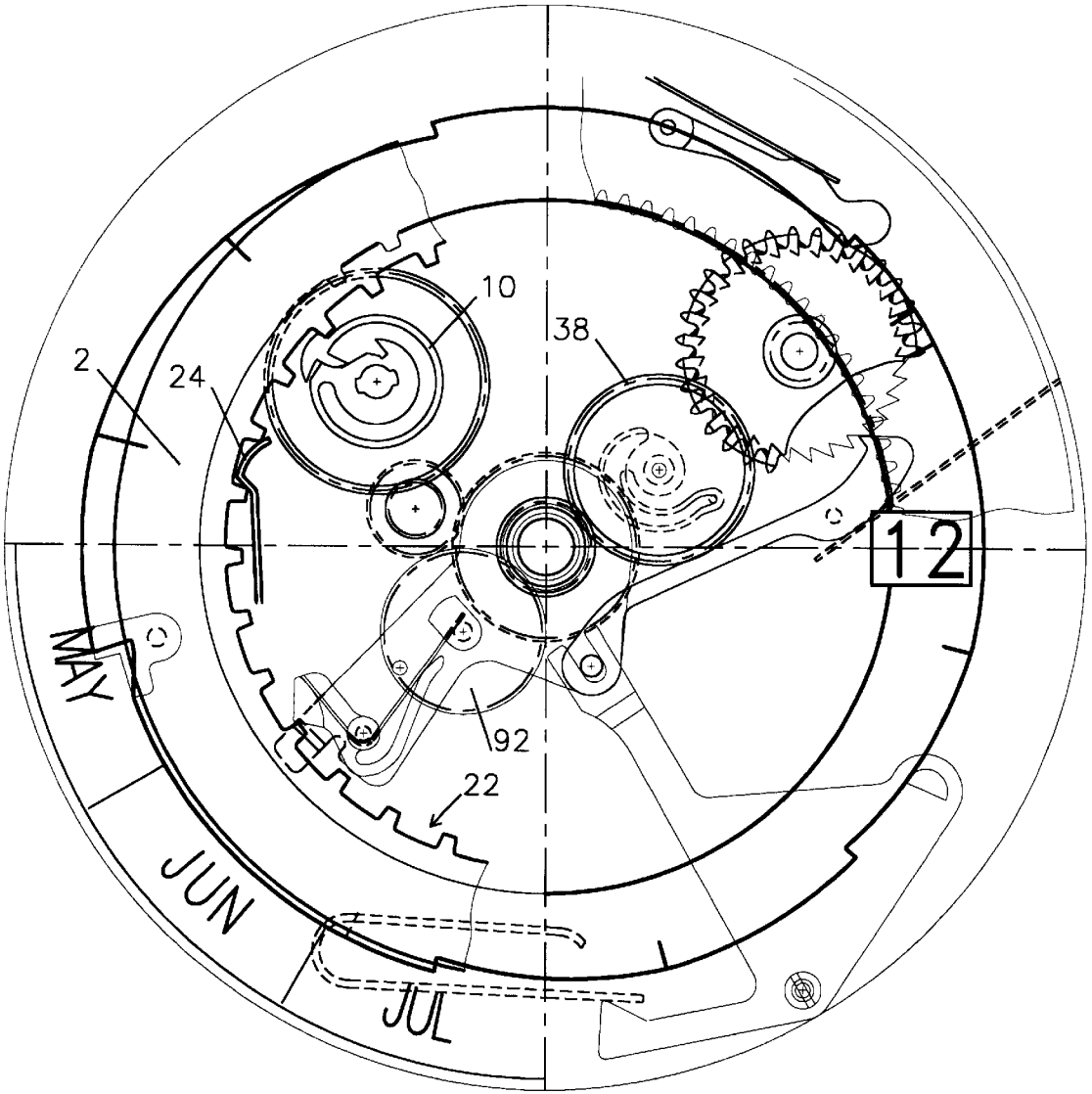

In FIG. 2, we see the conventional date driving device at 23:30 o'clock. The elastic arm 10 of the driving means has continued its winding, even though the ring 2 has not yet moved, this latter being maintained by the jumper spring 24. The two 24-hour wheels, respectively 38 and 92, have run through the complementary angle corresponding to the time elapsed between 21:00 and 23:30 o'clock, without any other function having taken place.

Figure 3:
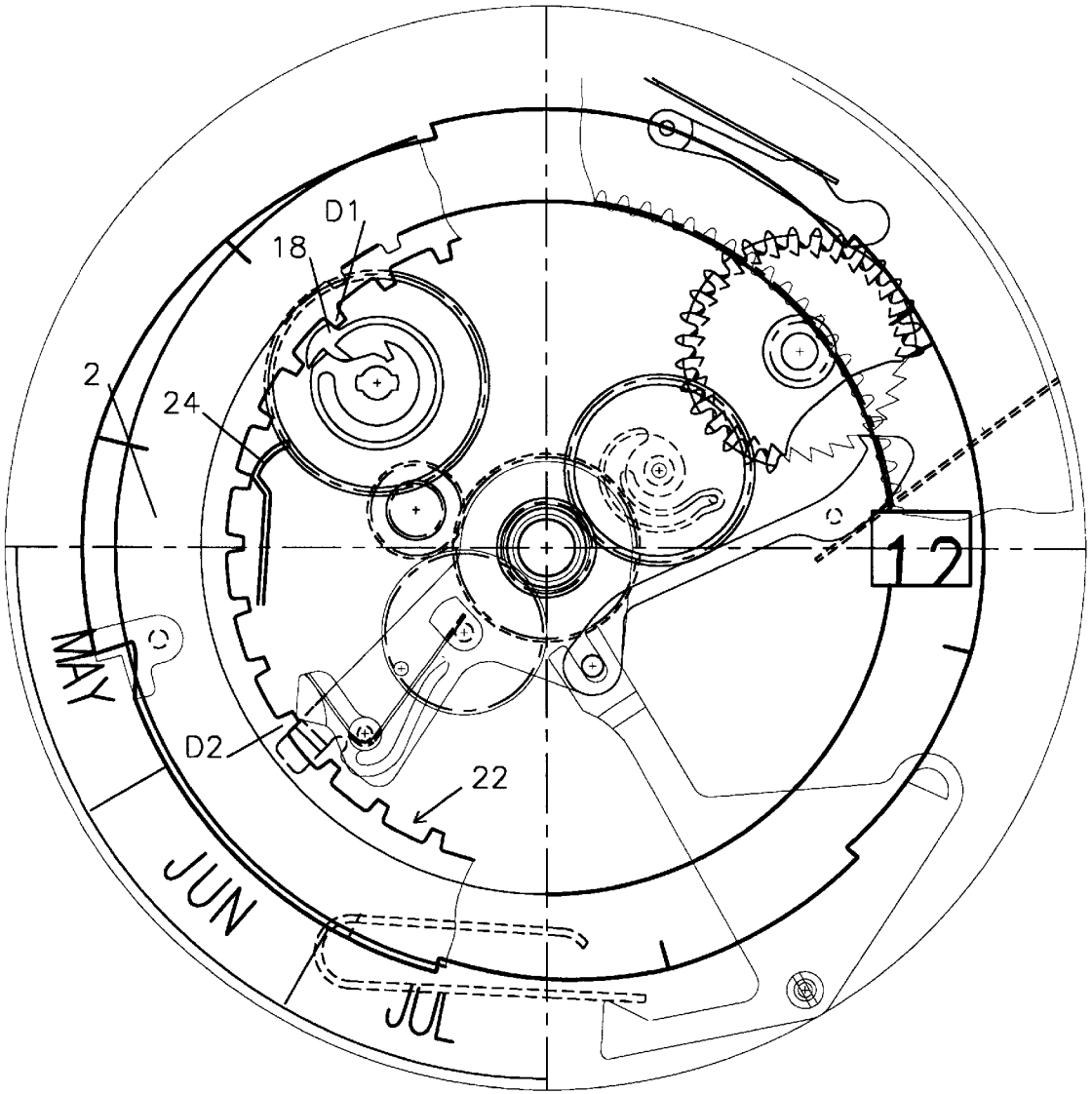

In FIG. 3, we see the conventional date driving device at 24:00 o'clock, the ring 2 being ready to jump once. The hook 18 has caused the ring 2 to advance during the half-hour preceding midnight. The jumper spring 24 has been raised during this brief period. It still holds the ring 2.

Figure 4:
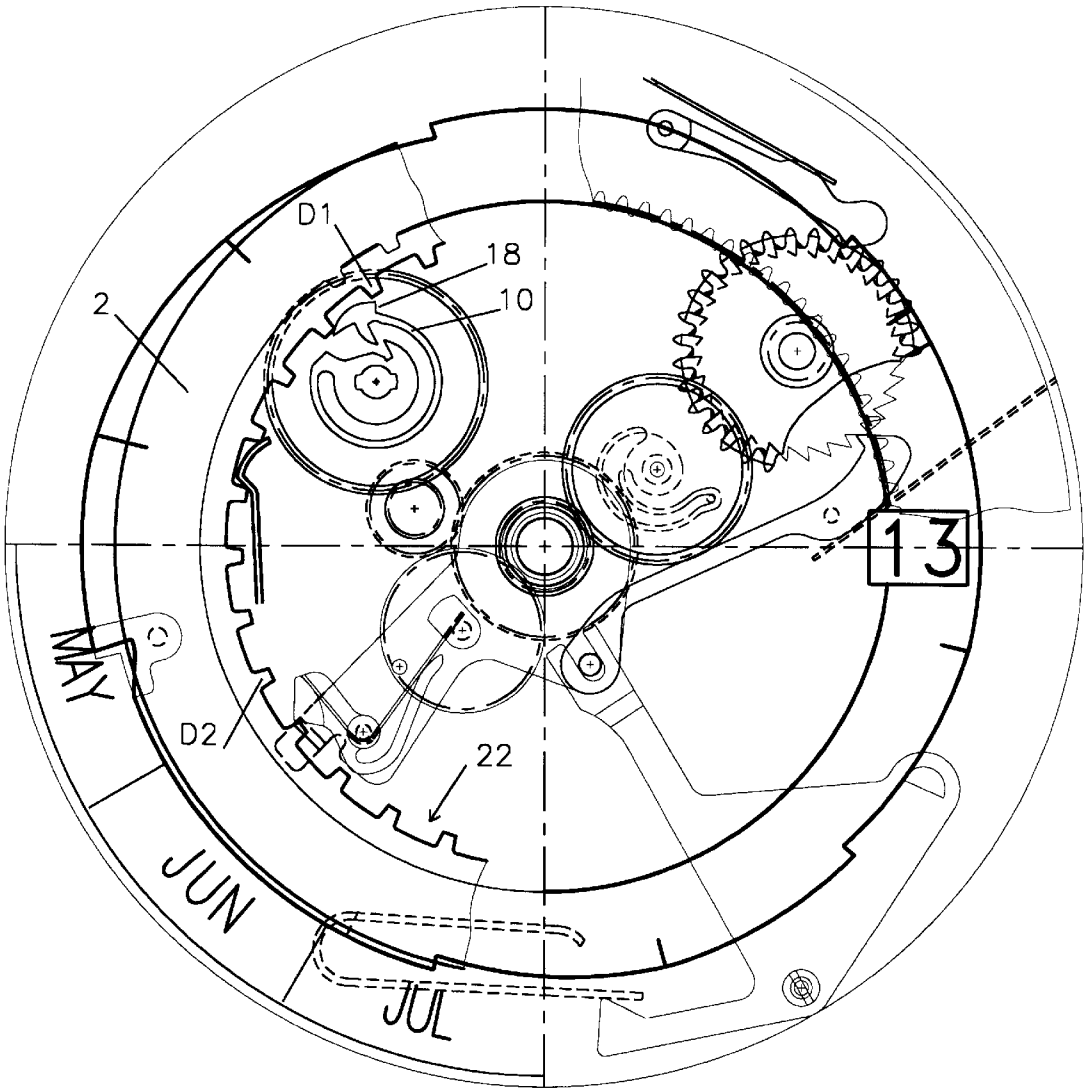

In FIG. 4, we see the driving device just after the ring 2 has jumped, that is, after the change to the $13^{th}$ of the month. The elastic arm 10 of the driving means has recovered its resting form. The hook 18 begins to disengage from the toothing 22 to enable the future rotation of the ring 2, at the end of months with fewer than 31 days.

Figure 5:
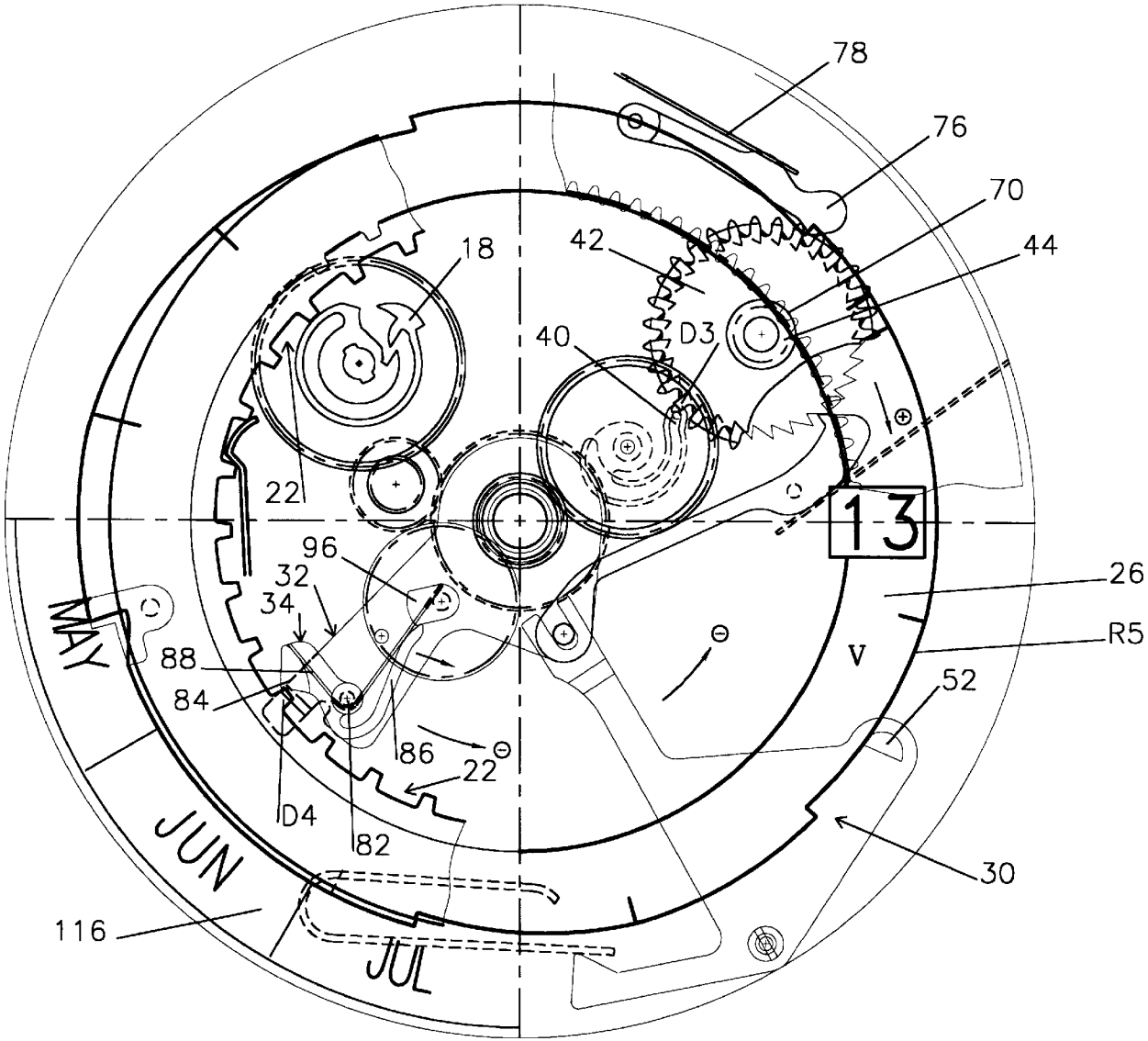

In FIG. 5, we see the condition of the movement after the aforesaid jump, at 2:00 o'clock in the morning. The hook 18 of the elastic arm 10 is completely disengaged from the toothing 22. The end of the finger 40 drives a tooth D3 of the 31-tooth wheel 42 until such time as the return force of the jumper 76 is overcome by the driving of the finger 40 and terminates the driving function of this wheel 42 under the action of the spring 78.

The pinion 44, which is integrated with the wheel 42, drives the cam 26 in rotation by means of the internal toothing 70 of this cam. Thus, the cam 26, which is integrated with the ring 116, will have performed an additional step of $1/372^{nd}$ of a turn in the clockwise direction, thus causing the pallet pin 52 to ascend the ramp R5, slowly moving the sensor 30 in the counterclockwise direction, and this sensor 30 driving the mobile assembly 32 in its travel.

During this period, the point of the tip 84 has risen against the flank of a tooth D4 of the toothing 22 of the ring 2. The arm 86 has been displaced angularly about its pin 82, the end of this arm being pushed by the inertial cam 96 and removing the tip 84 from the toothing 22.

The end of this arm 86 moves until such time as the inertial cam 96, by its 24-hour rotation, lets the pawl 34 fall back into the toothing 22, under the effect of the spring 88. During this entire period, the ring 2 is free to turn, in particular, under the action of a rapid date setting.

Figure 6:
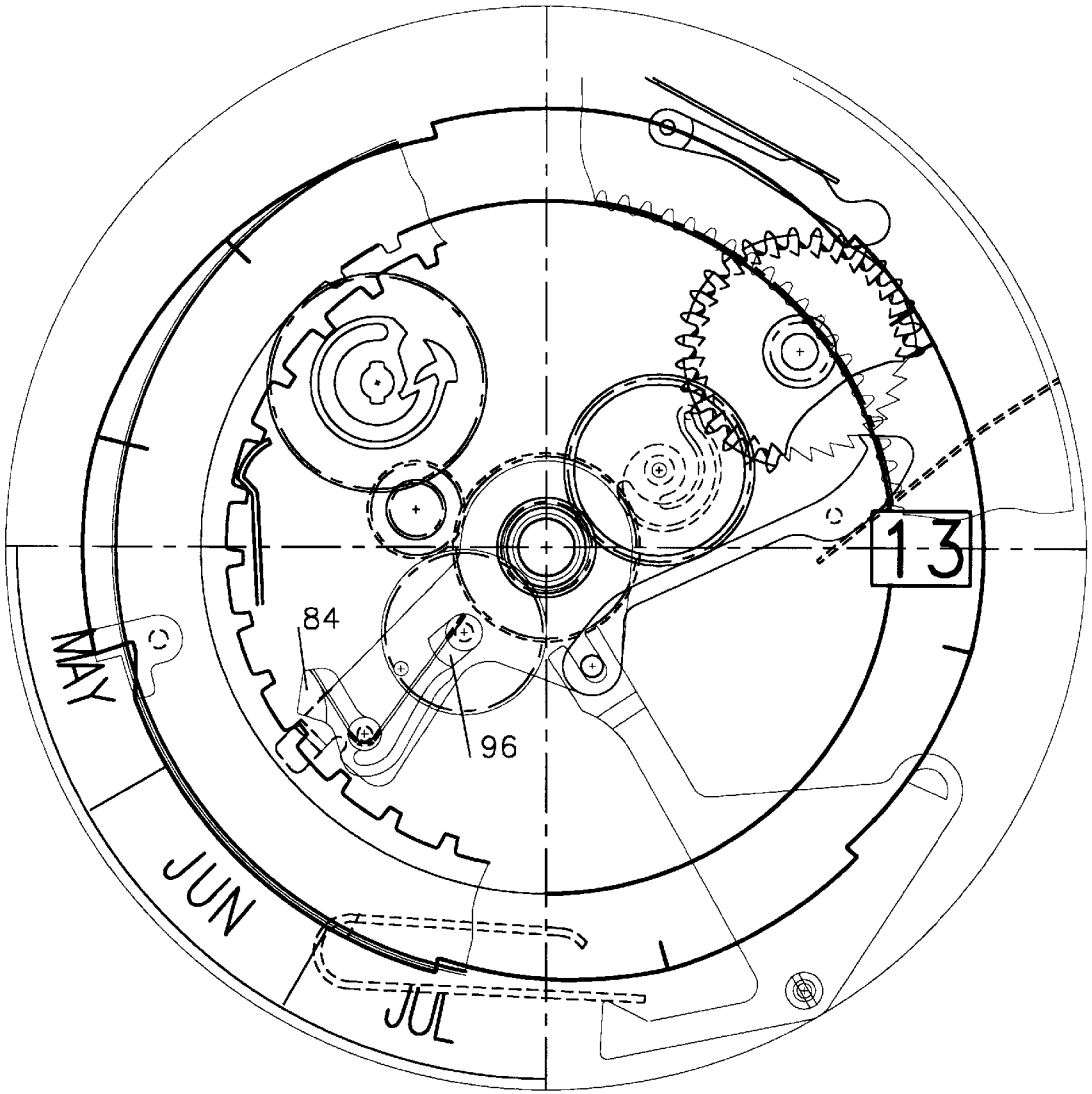

The maximum displacement of the pawl 34 being reached, in this configuration, around 4:00 o'clock in the morning, as we see in FIG. 6, which shows the position of the other mobile elements in movement at this time.

Figure 7:
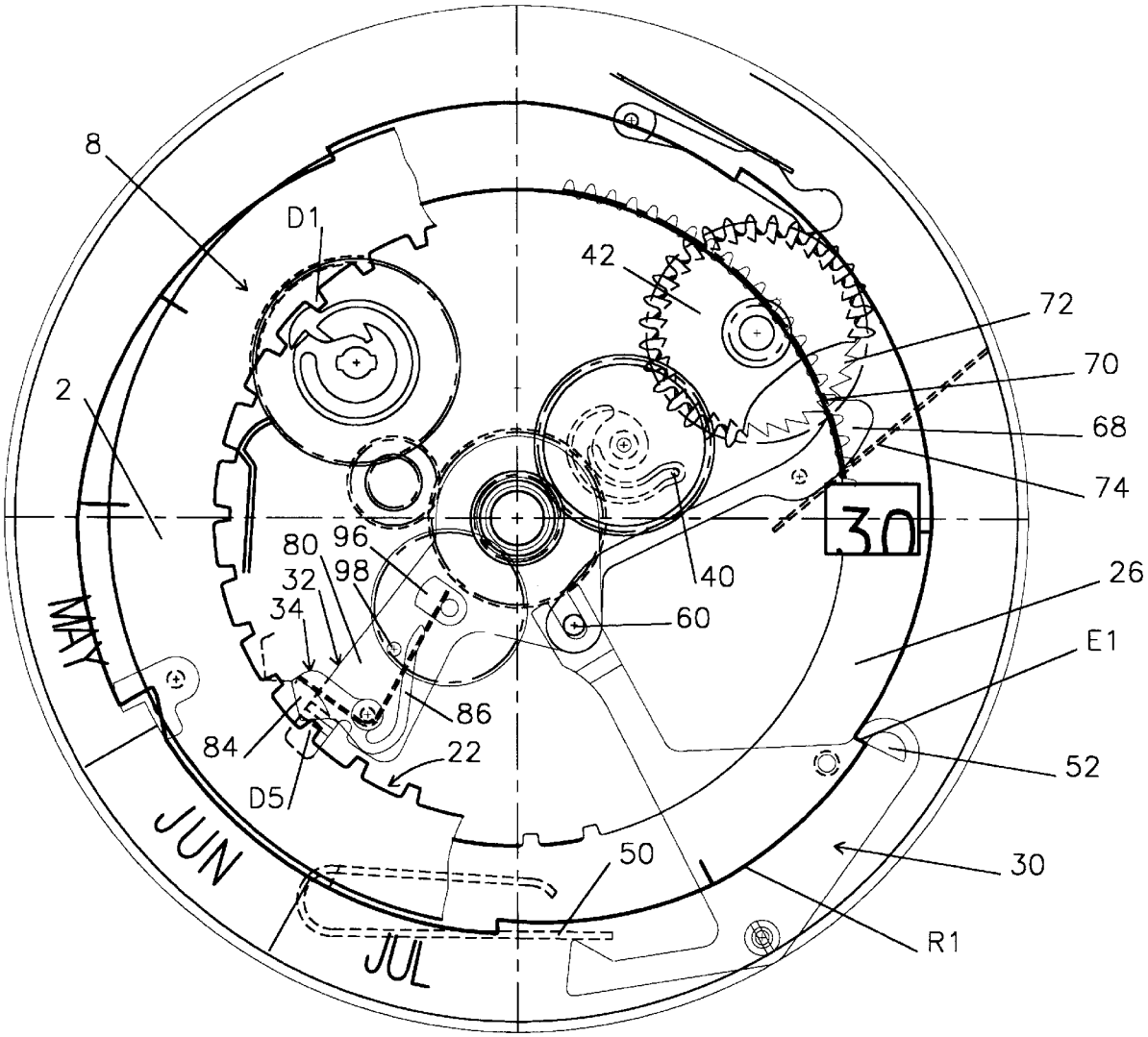
FIGS. 7–9 are views similar to FIGS. 1–6, but showing the condition of the movement before (FIG. 7), during (FIG. 8), and after (FIG. 9) the changing of the date at the end of a month having 30 days to the $1^{st}$ of the following month

FIG. 7 shows the movement under the same conditions as described previously for FIG. 3, but this time before the adjusting step of the ring 2 for the change from the $30^{th}$ to the $31^{st}$ of the month, for a month with 30 days.

During the following period, the inertial cam 96 will take up a position in front of the end of the arm 86 to lock it against the pin 98 and to immobilize the pawl 34 with respect to the base plate 80. At this time, the tip 84 of the pawl enters entirely into the toothing 22 of the ring 2.

At the same time, the articulated lever 68 is slowly moved under the action of the sensor 30, by the pin 60, to ascend the toothing of the wheel 72. The tip 70 of this lever has been engaged with the next recess of the wheel 72, under the action of the spring 74.

It will be noted that the pallet pin 52 still remains at the edge of the notch E1 of the cam 26 on the ramp R1.

As for FIGS. 1–5, the driving device 8 will be wound and, around midnight, it will cause the ring 2 to turn for the jump from 30 to 31, as we see in FIG. 8.

FIG. 8 shows the situation of the movement at 2:00 o'clock in the morning, just before making the adjusting step, from the $31^{st}$ to the $1^{st}$.

The hook 18 is completely disengaged from the toothing 22. At this time, the pawl 34 and, more particularly, its tip 84 is immobilized on the base plate 80 by the inertial cam 96 and the pallet pin, which is at the edge of the notch E1, is ready to fall into this notch.

Figure 9:
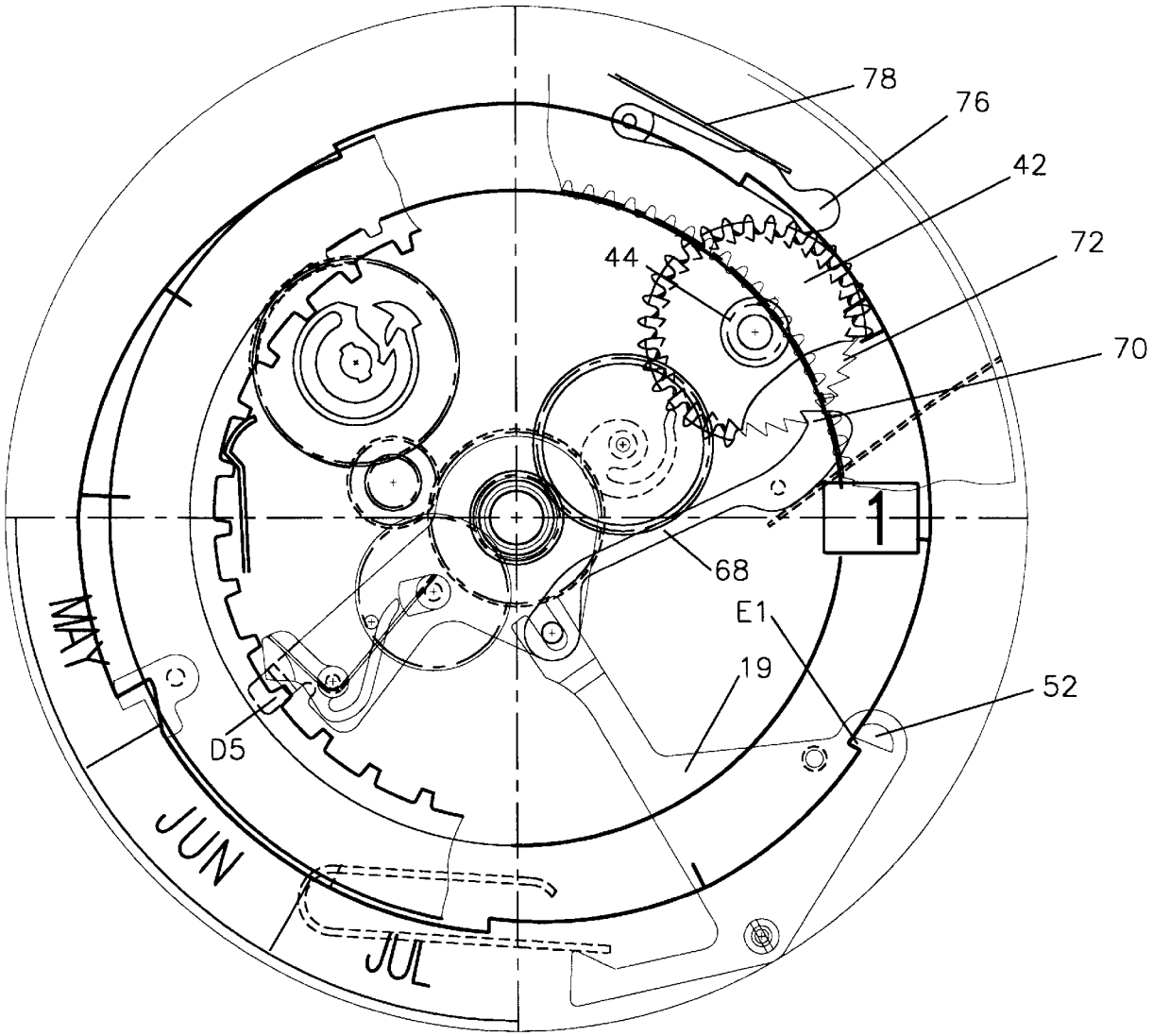

The finger 40 then drives the wheel 42 by one step to make the cam 26 advance by a corresponding step. The advance of the cam 26 causes the pallet pin 52 to fall into the notch E1, under the action of the spring 50. In its travel, the sensor 30 causes the mobile assembly 32 to rotate, which then causes the ring 2 to advance by one adjusting step, thanks to the tip 84 which is immobilized by the inertial cam 96 (FIG. 9).

It will be noted that, in this regard, during the adjusting step, the inertia of the ring 2 is not controllable, especially since the energy distributed by the spring 50 is variable, as a function of its winding, which itself depends on the depth of the notches E1 to E5. The solution to this problem consists in locking the pawl 32 by the inertial cam 96, as mentioned above. This locking is done at the time when the adjusting jump is performed, which thus maintains the tip 84 in the toothing 22 of the ring 2.

Thus, after the advancement of the ring 2 by one step, the preceding tooth D5 will abut against the heel of the tip 84, thus preventing the ring 2 from passing over an additional tooth.

It shall be specified, moreover, that since the inertial cam 96 is constantly turning, the pawl 32 is free for most of the time and especially when the traditional changing of the date occurs at midnight. However, if a rapid date change should occur at the moment when the cam is locking the elastic arm 86, in particular, between the period following the traditional jump at midnight and the adjusting jump at the end of the month, the elastic arm 86 has the necessary flexibility to pass over one or more teeth of the toothing 22 above the point of the pawl 84.

As further commentary, let it be stated that, during the consecutive days of months with 31 days, the pallet pin 52 progressively ascends one of the ramps R1 to R5 of the cam 26. During this travel, which represents in the case of ramp R1 the interval between two months, the spring 50 has been progressively stretched by the arm 62 of the sensor 30 and has wound the sensor 30 to fall into the notch E1 when the finger 40 has initiated the displacement of the cam 26. When the sensor 30 progresses along the ramp R1, it pivots about its pivot pin 64 and thereby produces an angular displacement of the mobile assembly 32, by means of the pin 60. When the sensor 30 ascends the ramp R1, it pivots in the clockwise direction and displaces the mobile assembly 32 angularly in counterclockwise direction. At the moment when the pallet pin 52 falls into the notch E1, the sensor 30 pivots about its axis 64 in the counterclockwise direction and displaces the mobile assembly 32 angularly in the clockwise direction, which causes the ring 2 to perform the required adjusting step. The tip 84 of the pawl 34, which is immobilized by the inertial cam, then pushes the toothing 22 in the clockwise direction. At the same time, the rotational movement of the sensor 30 causes the wheel 72 to rotate, by traction against the lever 68. The wheel 72 being integrated with the pinion 44, the traction movement of the lever 68 likewise produces a rotation of the cam 26 by the same adjusting step, so that this cam 26 remains in phase with the periods of the following months.

FIG. 9 shows the situation of the movement after the adjusting step, at the change from the $31^{st}$ to the $1^{st}$, at the end of a month with 30 days.

During the step, that is, at the moment when the sensor has fallen into the notch E1, the articulated lever 68 by the driving of its tip 70 has caused the mobile element of the wheels 42, 72 and 44 to turn one step. Thus, the pallet pin 52 has not fallen straight to the bottom of the notch E1, but to a distance from the vertical wall of the notch E1, this distance corresponding to one day for the end of a month with 30 days.

Figure 10:
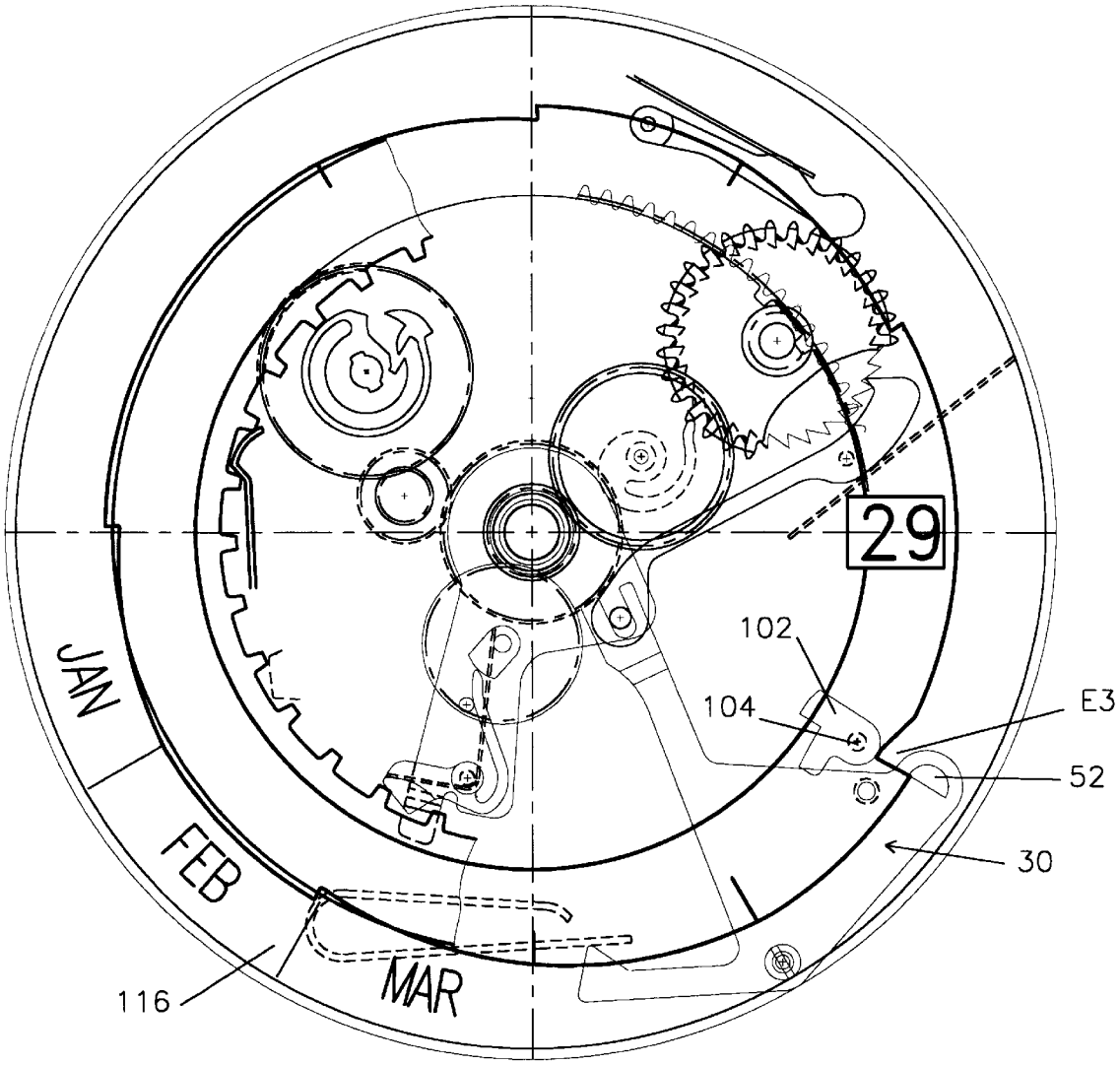
FIGS. 10 and 11 are views similar to FIGS. 7–9, but showing the condition of the movement before (FIG. 10) and after (FIG. 11) the changing from the $29^{th}$ of the month to the $1^{st}$ of the following month, for the month of February with 28 days (non-leap year)
Figure 11:
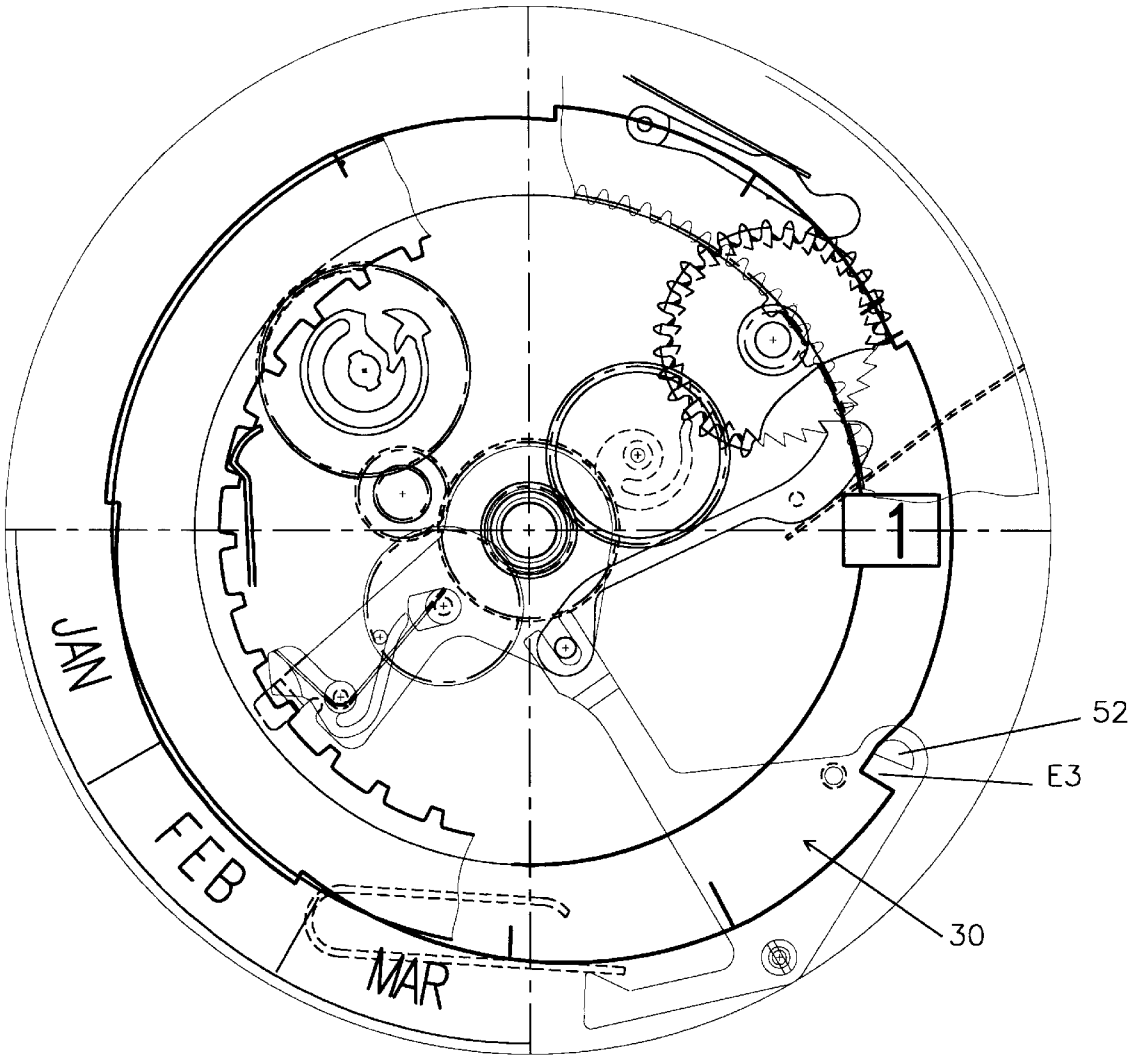
Figure 12:
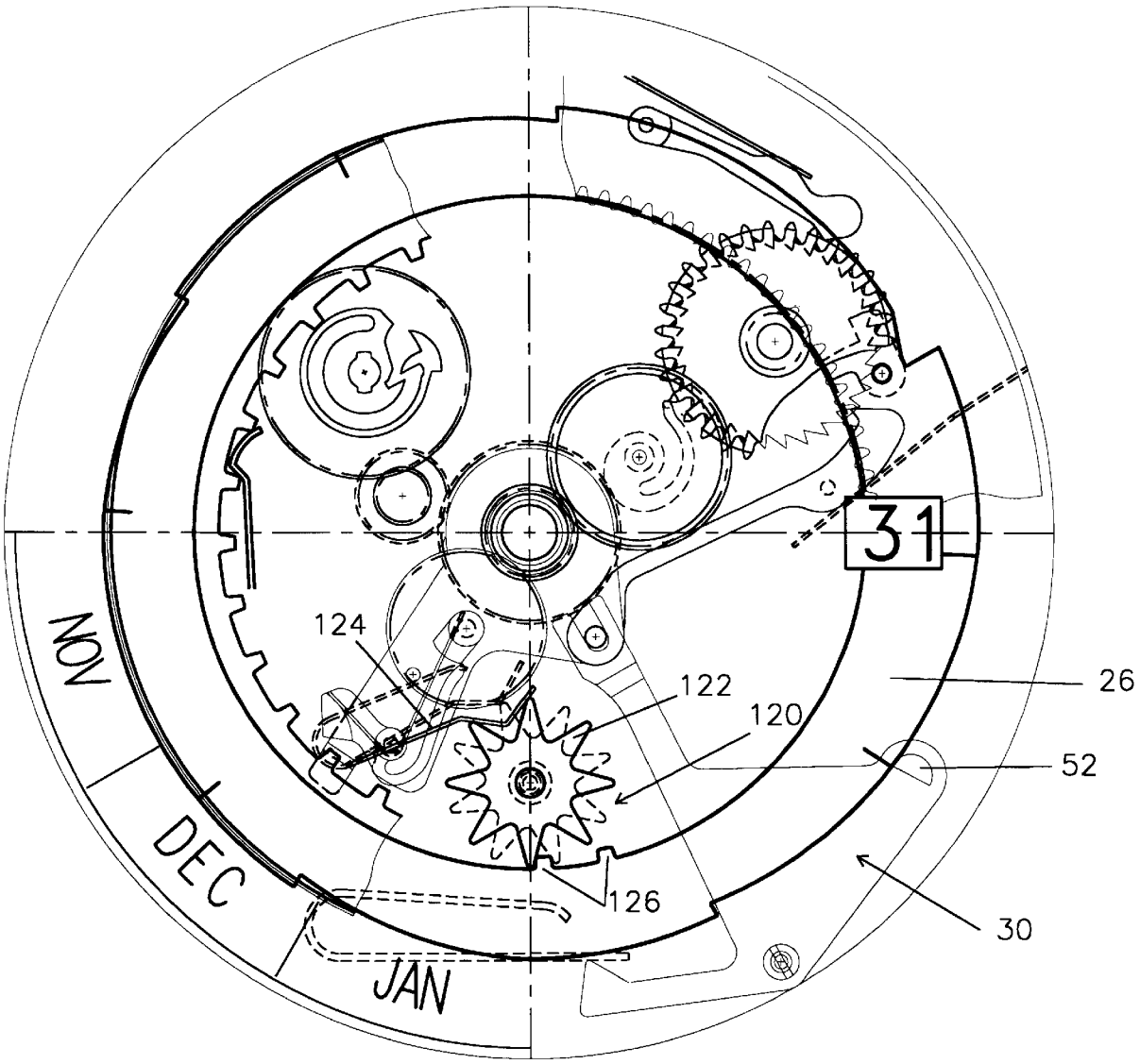
FIG. 12 is also a top view of the movement according to the invention, shown equipped with a device to display leap years.

FIGS. 10 and 11 show the situation of the movement before and after the three adjusting steps, for the change from the $29^{th}$ to the $1^{st}$, at the end of a month with 28 days.

The mechanism of the movement according to the invention functions identically to what has been described above, with the difference that the number of steps is determined by the depth of the notch E3. This notch has a predetermined depth so that the displacement of the sensor 30 in this notch causes the ring 2 to move by three steps, thanks to a corresponding angular displacement of the mobile assembly.

However, at the end of the month of February of leap years (see FIGS. 14 and 15), the notch E3 may be partially obstructed to only produce a displacement of the ring 2 by two steps and one day later on. The obstruction of this notch E3 is accomplished at the right time by means of the mechanism 100 described above, in particular, by the flap 102.

What is claimed is:

1. Timepiece movement provided with a perpetual-date calendar mechanism, comprising a driving device of a date indicator, having driving means to make said indicator advance by one jump every 24 hours, characterized in that it further comprises an adjusting device, able to make this indicator perform adjusting steps, to automatically allow for months with 28, 29 or 30 days, this adjusting device comprising a rotary cam, driven at least one step every 24 hours, this cam having a profile which controls a sensor, bringing about:

on the one hand, the oscillating movement of a mobile assembly provided with a pawl system, to make the date indicator advance by the required supplemental adjusting step or steps, and on the other hand, the advancement of said cam to make it perform a number of steps equal to the number of adjusting steps of said indicator so that it performs one complete turn per year.

2. Movement according to claim 1, characterized in that said cam is driven by a gear train connected to the hour wheel.

3. Movement according to claim 2, characterized in that the gear train has a first mobile element, engaging with the hours wheel, this first mobile element having a driving finger, actuating a 31-tooth wheel belonging to a second mobile element, whose pinion drives said cam.

4. Movement according to claim 1, characterized in that said sensor contains a first arm, resting under the action of a return spring against the profil of the cam, and a second arm, which is connected to the first by a junction piece and which is coupled to the mobile assembly, said sensor being able to pivot on a plate, by its junction piece.

5. Movement according to claim 4, characterized in that said sensor further contains a third arm, against which said return spring works.

6. Movement according to claim 1, characterized in that it comprises a mobile lever, controlled by said sensor and engaging with a wheel, integrated with a mobile element, meshing with said cam.

7. According to claim 6, characterized in that said mobile element is constituted by said second mobile element.

8. Movement according to claim 3, characterized in that said mobile element is constituted by said second mobile element.

9. Movement according to one of claim 6, characterized in that said wheel comprises a toothing of the saw tooth type.

10. Movement according to claim 1, characterized in that said mobile assembly has a base plate, mounted in rotation about an axis (R) in common with the hours wheel.

11. Movement according to claim 1, characterized in that said pawl has an actuating tip designed to drive the date indicator, this pawl interacting with a system of locking which, in a first position, holds said tip almost stationary so that this tip ensures the driving of the date indicator and which, in a second position, releases said tip so that it performs its function of a ratchet, with respect to the date indicator, upon actuation of the latter, in particular, by the driving device.

12. Movement according to claim 11, characterized in that said system of locking is designed to lock, every two months, the displacement of the arm of the pawl, to disable it at the time of the adjusting step or steps.

13. Movement according to claim 12, characterized in that the system of locking contains an inertial cam, integrated with a 24-hour wheel engaging with a pinion, mounted on an hour cannon.

14. Movement according to claim 13, characterized in that said inertial cam and the 24-hour wheel are mounted in rotation on the base plate of the mobile assembly.

15. Movement according to claim 10, characterized in that said inertial cam and the 24-hour wheel are mounted in rotation on the base plate of the mobile assembly.

16. Movement according to claim 1, characterized in that said cam has an annular shape and surrounds the mobile assembly.

17. Movement according to claim 1, characterized in that the profile of the cam is formed by five contiguous sectors (I to V), joined together by recesses forming notches (E1 to E5), whose depth determines a displacement of the sensor corresponding to the required number of adjusting steps.

18. Movement according to claim 17, characterized in that one of the notches (E3) has a greater depth than that of the other four notches (E1, E2, E4, E5), the latter having equal depth.

19. Movement according to claim 18, characterized in that the cam interacts with a system capable of varying, once every four years, the depth of the deepest notch (E3).

20. Movement according to claim 19, characterized in that said system is constituted of a mobile flap mounted in rotation on said cam, and integrated with a wheel, actuated to rotate a quarter turn every year, so that this flap will obstruct the notch (E3) to reduce its depth and lengthen one of the sectors (III) of the cam.

21. Movement according to claim 20, characterized in that said wheel has four teeth and interacts once a year with a fixed finger of the movement, which controls its rotation.

22. Movement according to claim 1, characterized in that it comprises a device for indication of leap years, this device comprising a star driven by the cam.

23. Movement according to claim 22, characterized in that said device comprises a star with eight branches and two driving teeth, integrated with the cam, capable of driving the star respectively by an eighth of a turn.

24. Movement according to claim 1, characterized in that the date indicator is an annular ring extending above said rotary cam.

25. Movement according to claim 1, characterized in that said rotary cam is associated with a month ring.

* * * * *